US006026914A

United States Patent [19]

Adams et al.

[11] Patent Number: 6,026,914

[45] Date of Patent: Feb. 22, 2000

[54] WELLBORE PROFILING SYSTEM

[75] Inventors: John R. Adams; Ross Hay, both of Calgary, Canada

[73] Assignee: Alberta Oil Sands Technology and Research Authority, Alberta, Canada

[21] Appl. No.: 09/014,691

[22] Filed: Jan. 28, 1998

[51] Int. Cl.[7] ..... E21B 47/02

[52] U.S. Cl. ..... 175/45; 73/152; 175/48

[58] Field of Search ..... 175/40, 45, 48, 175/62; 73/152, 152.22, 152.44, 152.52

[56] References Cited

U.S. PATENT DOCUMENTS

| | | | |
|---|---|---|---|
| 4,875,292 | 10/1989 | Gibson | 175/45 |
| 5,333,686 | 8/1994 | Vaughan et al. | 175/48 |
| 5,585,726 | 12/1996 | Chau | 175/45 |
| 5,695,015 | 12/1997 | Barr et al. | 175/45 |

*Primary Examiner*—David Bagnell
*Assistant Examiner*—George M. Mihalik
*Attorney, Agent, or Firm*—Sheridan Ross P.C.

[57] ABSTRACT

A method is presented for accurately surveying and determining the profile of the path of a subterranean wellbore containing a constant density fluid extending contiguously throughout. A first pressure sensor, associated with a downhole tool, is traversed station-by-station along the wellbore for measuring the pressure of the fluid within the wellbore at each station. A second pressure sensor is located within the wellbore fluid at a known elevation. The elevation of the first pressure sensor, at a station, is determined by adding the calculated differential height to the known absolute elevation of the second sensor. As each elevation is referenced to the second sensor, no cumulative errors are incurred. If the density of the fluid is unknown, a third pressure sensor within the wellbore fluid can be provided at a known elevation different from that of the second sensor. The areal position of each station is determined by conventional means associated with the downhole tool. The elevation for each of a plurality of stations is combined with the areal position determined at each station to determine the path of the wellbore.

8 Claims, 8 Drawing Sheets

WELLBORE PROFILING SYSTEM

FIELD OF THE INVENTION

The present invention relates to a method for accurately surveying and determining the profile of the path of a subterranean wellbore.

BACKGROUND OF THE INVENTION

Prior art instruments are used for surveying the path of a subterranean wellbore. The instruments are carried by a tool which is moved along the wellbore by a wireline or pipe string. The tool is stopped at locations or stations spaced along the length of the wellbore. Measurements relating to dip angle, azimuth and roll can be taken at the station. The position of the tool along the length of the wellbore is known from measuring the length of wireline or pipe in the well. These measurements provide information with respect to the heading and path of the wellbore for determination of each station's elevation and areal position (its position in the horizontal plane as viewed in plan).

With every measurement taken, there is an associated error. With the prior art tools, each measurement is referenced from the previous measurement. Errors from previous measurements are added to subsequent measurement errors, accumulating and, in a worst case, compounding. This linearly additive error can become significant after a number of stations.

The extent of error can vary between the different types of tools.

The "gyro" tool is one of the most accurate of the tools. Its additive errors are fairly small and are generally acceptable for most applications. The gyro tool utilizes a spinning gyro to measure the rate of change of the tool's dip angle (up and down), azimuth (horizontal left and right) and roll (rotation about the tool's axis). A disadvantage of the gyro tool is its fragility and susceptibility to failure during use, in what is typically a rough handling environment.

Another type of tool, known as a magnetic flux gate and slant tool, combines measurements of the tool's horizontal orientation relative to the earth's magnetic field (azimuth) and dip and roll angles using pendulums and other means. These magnetic tools can be affected by other magnetic influences and must be positioned within a non-magnetic drill collar.

Another commonly used tool is the MAXIBOR tool (MAXIBOR is a registered trademark of Reflex Instrument AB, Sweden). The MAXIBOR tool uses an optical system to measure dip and azimuth by monitoring the extent of bending of the tool along its length. The bending is caused by the curvature of the wellbore. The roll of the tool is determined using a liquid level. The deflection of the drill string and wellbore is calculated from measurements recording the deflected centerline offset of a plurality of normally coincident reflective rings, spaced at known distances along the bore of the tool's length, and establishing the orientation of the rings with respect to gravity. The accuracy achieved with the MAXIBOR tool is markedly affected by the fit of the tool within the wellbore. The tool is provided with centralizers to centralize the tool within the bore of the drill string. A loose fit is often required so as to enable the centralizers to clear drill string joints and pass narrow diametral bore tolerances. A loose fit reduces the net deflection of the tool and understates the wellbore deflection.

All of the above-mentioned tools are relative-measurement tools and, when used, must involve a traverse (survey from station-to-station) of the entire wellbore, from an unknown point to a known point or visa versa. By way of example, if a wellbore is 700 m long and the reference station is at the beginning of the wellbore, then, in seeking a profile of the last 60 m one would have to traverse the entire length of the wellbore to obtain the desired information. One must know the absolute coordinates (elevation and areal position) of at least one point in order to tie, or anchor, the measured coordinates to an absolute location in three dimensional space. This serves the same purpose, though it is not as complete, as closing the loop of a surface survey to see if accumulating errors have prevented one from returning to the same place one started from. If the entire survey is not performed, then the measured data is left "floating" without a correlation to a known point in three dimensional space. Carrying out an entire traverse is time consuming and successive surveys typically demonstrate variable amounts of non-repeatability in the measured survey end-points.

Both the magnetic and the MAXIBOR tools are less accurate than the gyro tool. While the accuracy of these tools may be adequate for some drilling exercises, it is not adequate where close control of the absolute coordinates of the wellbore is required.

The present invention was developed in conjunction with a pilot project that required very accurate control of wellbore locations. This project was referred to as the Underground Test Facility ("UTF"). It was operated in the Athabasca reservoir, which contains immobile, viscous heavy oil or bitumen. The project involved sinking a vertical, concrete-lined shaft from surface, through an oil sand reservoir and into an underlying limestone strata. A horizontal tunnel was mined through the limestone. Wells were drilled upwardly out of the tunnel to the base of the oil sand and then turned to extend generally horizontally through the oil sand, parallel and close to its bottom surface. The wells were provided in pairs: a lower production well and an upper steam injection well. The production well was drilled first. It had some deviation both in profile and plan. The injection well was then drilled with a view to tracking the production well so that it remained directly over the latter in coextensive, parallel, vertically spaced apart relation. An oil recovery process referred to as steam assisted gravity drainage ("SAGD") was then implemented. Initially, steam would be circulated through both wells to create "hot fingers". The viscous oil in the interval between the wells would be heated by conduction and would drain downwardly so that a "fluid communication" zone would be opened between the wells. Then the upper well would be converted to steam injection and the lower well would be converted to fluid production. The injected steam would ascend and heat the upwardly expanding surface of a chamber from which heated oil had drained. The mobilized oil and condensed steam would drain into the lower well and be produced into the tunnel, from whence it was recovered to ground surface.

Now, it is essential that the pair of wells be drilled so that the injection well was directly above the production well and spaced a constant distance from it. If the wells drifted apart too much in profile or plan, an inordinate amount of time would be required to heat the span between them by conduction.

It was thus necessary:

- to know accurately the path of the production well, in profile and plan; and
- to accurately know and control the path of the injection well during drilling, to cause it to closely track the production well.

A wellbore path may be described as laying within two orthogonal planes: the profile, which represents vertical or elevation variations of the wellbore occurring over the wellbore's length; and the plan, which represents horizontal variations occurring over the wellbore's length.

The SAGD process is particularly sensitive to variations in the profile which impact the vertical separation of the injection and production wellbores and adversely affect performance.

This sensitivity may be demonstrated by examining the effect an error can have on a typical horizontal wellbore extending in excess of 600 meters in length. This wellbore, say it is the production well, will not lay in a perfectly straight line but will typically vary somewhat. An acceptable imaginary target envelope would have an injection well positioned somewhere within an upper bounding surface defined by a 90° arc and a horizontal base positioned about 3 to 7 meters above the producer. Ideally, the injection wellbore would remain about 4 to 5 meters directly above the production wellbore. For a wellbore length of over 600 meters, an error in measuring the heading of a wellbore near its start of about 1° will result in an indicated end of the wellbore being skewed over 10 meters from its actual end. Errors of this magnitude do not permit a driller to confidently project that a SAGD injection wellbore will successfully track the production well within the desired envelope.

Thus, a system is required that can accurately determine the path of a wellbore, particularly with respect to its profile. This would better enable one to accurately position the injection wellbore of an SAGD project relative to a production wellbore.

SUMMARY OF THE INVENTION

A method is provided for accurately determining the profile of a wellbore.

Pressure sensors are provided which are in pressure sensing communication with the fluid in the wellbore. This fluid extends contiguously (i.e. continuously) throughout the wellbore (including the bore of the drill string) and is of substantially constant density. A first pressure sensor is moveable to a plurality of locations, or survey stations, in the wellbore. A second pressure sensor is stationary along the length of the wellbore, at a known elevation and areal position. Differential pressure is measured between the first and second sensors. Knowing the density of the fluid, the differential height of the first sensor can be determined with respect to the second sensor. The absolute elevation of the first sensor is obtained by adding the differential height to the known elevation of the second sensor. The differential height may be a positive or negative value. The elevation of the first sensor can be obtained at a plurality of stations along the wellbore, each elevation being referenced to the stationary second sensor elevation and therefore not being subject to linearly additive errors. The first pressure sensor is associated with or carried by a downhole tool to facilitate its positioning at each station in the wellbore.

Preferably, the downhole tool also carries means for measuring the dip angle of the tool for determining the horizontal position of the first sensor at each station. Knowing both the absolute elevation and the horizontal position at each station, one can accurately determine the profile of the path of the wellbore.

If the tool also carried means for measuring the azimuth of the tool, the areal position (two-dimensional location in a horizontal plane) of the first sensor at each station can be determined. Knowing both the absolute elevation and the areal position at each station, one can accurately determine both the profile and plan of the path of the wellbore.

In one broadly stated aspect of the invention, a method is provided for determining the elevation at a survey point in a subterranean wellbore which is being drilled with a drill string which contains a continuous column of fluid having a known and substantially constant density, comprising:

- positioning a downhole tool in the drill string at the survey point which measures fluid pressure;
- providing means for measuring fluid pressure at a reference point of known elevation, said reference measuring means being in pressure sensing communication with the column of fluid;
- providing means located outside the wellbore for calculating elevations from differential fluid pressures;
- measuring the fluid pressure at the reference point and transmitting a signal indicative of the measurement to the calculating means;
- measuring the fluid pressure at the survey point and transmitting a signal indicative of the measurement to the calculating means; and
- calculating the elevation of the survey point knowing the pressure measurements, the density of the fluid and the known elevation of the reference point.

If the density of the fluid is not known, it is preferable to determine it by:

- providing means for measuring fluid pressure at a second reference point of known elevation different from the elevation of the first reference point, both reference points being in pressure sensing communication with the column of fluid;
- measuring the fluid pressure at the second reference point and transmitting a signal indicative of the measurement to the calculating means; and
- calculating the density of the fluid knowing the pressure measurements and the known elevations of the first and second reference points.

By moving the tool from survey point to survey point, and knowing the horizontal distance traversed, a two dimensional profile can be accurately determined. If the profile at any time is known, the directional drilling of a wellbore can be usefully guided.

Accordingly, In another aspect, a method is provided for determining the path of a wellbore having a bore containing a continuous column of fluid having a substantially constant density, comprising:

- positioning a downhole tool at a survey point in the bore, said tool carrying means for measuring fluid pressure, means for measuring the traversed distance of the tool along the wellbore, and means for measuring the dip angle of the tool, all measured at the survey point;
- providing means for measuring fluid pressure at a reference point of known elevation along the length of the column of fluid;
- establishing measures indicative of the elevation of the tool at the survey point using the differential between the fluid pressure at the survey point and the reference point and the fluid density;
- establishing measures of the dip-angle of the tool at the survey point;
- establishing measures of the traversed distance of the tool to the survey point;
- establishing measures of the horizontal location of the tool using the traversed distance and the orientation of the tool at the survey point;

moving the tool and measuring means to a new survey point; and repeating the measurement and moving steps for determining measures indicative of the profile of the path of the wellbore knowing the elevation, horizontal position and dip angle of the tool, where the azimuthal deviation of the path assumed to be zero.

Preferably, by providing means on the tool which also measure the azimuthal orientation of the tool at the survey point, one may determine the departure of the survey point and determine both the profile and plan of the path of the wellbore.

Once the path of the wellbore is known, the advance of a drilling string in a horizontally extending wellbore can be controlled by:

additionally providing means associated with the tool for measuring the tool's rotational orientation from vertical and means for measuring the bent sub's rotational orientation relative to the tool, also measured at the survey point;

performing the measurement and tool-moving steps for determining the path of the wellbore; and re-orienting the bent sub's rotation to change the direction of advance of the drilling string knowing the rotational orientation of the bent sub relative to the tool and the tools rotational orientation from vertical.

BRIEF DESCRIPTION OF THE DRAWINGS

FIG. 5 is a graph comparing the X-Y profiles of the B3 production wellbore, as determined by each of a pressure tool and a gyro tool;

FIG. 6 is a graph comparing the Z-X departure profiles of the B3 production wellbore, as determined by each of a FOTOBOR1 tool and a gyro tool;

1 trade mark

Figure 7:
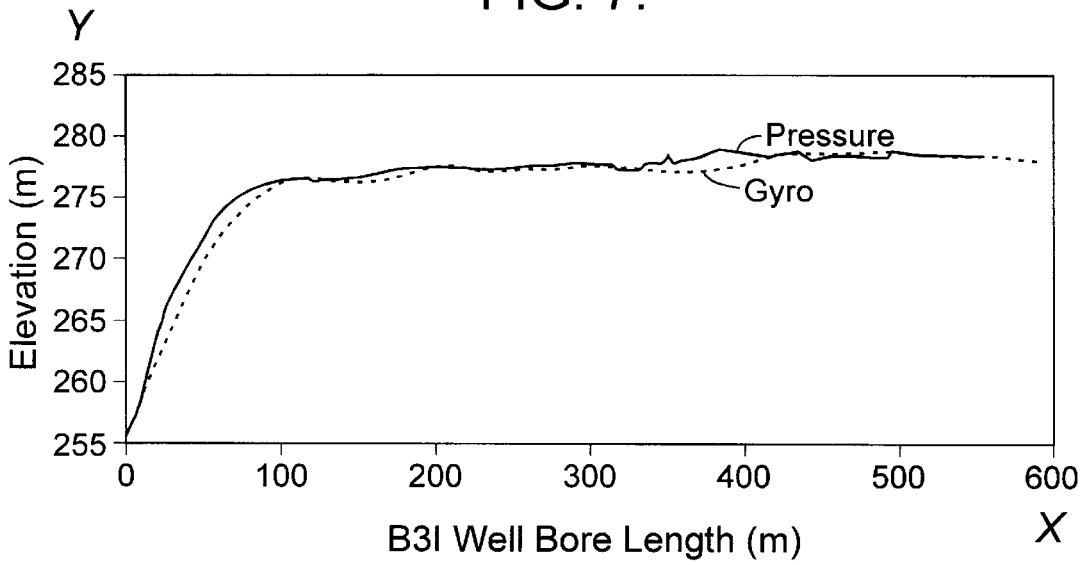
Figure 8:
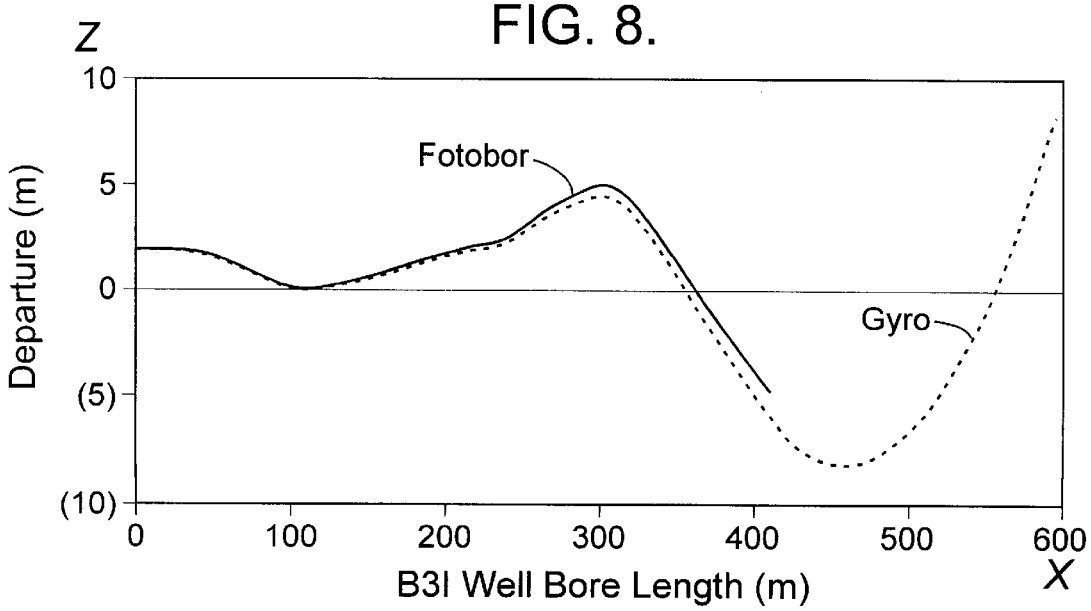
Figure 9:
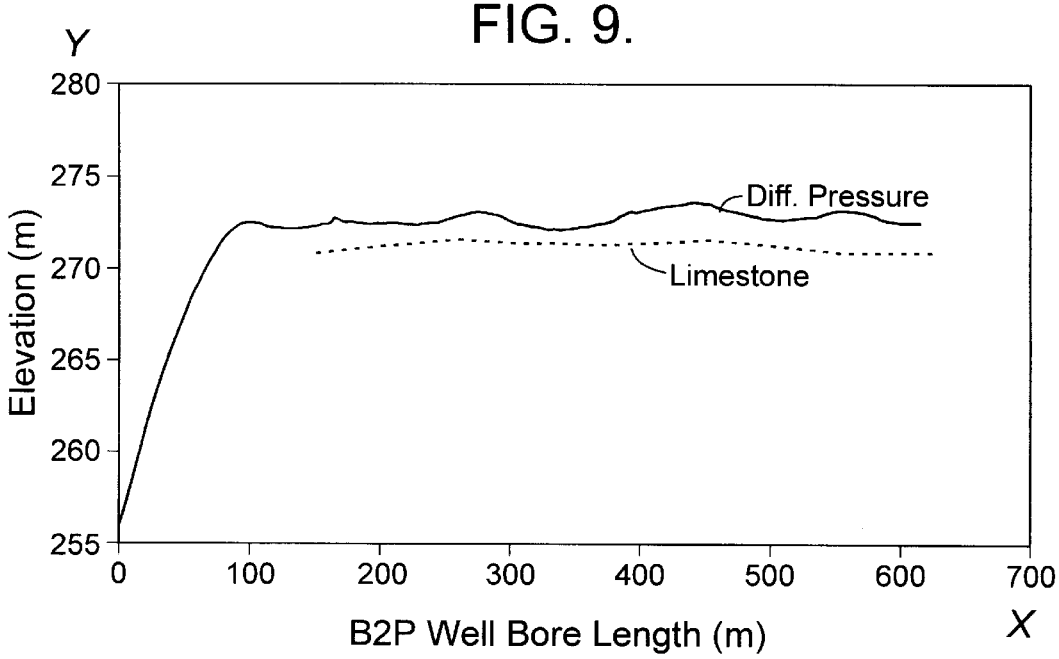
Figure 10:
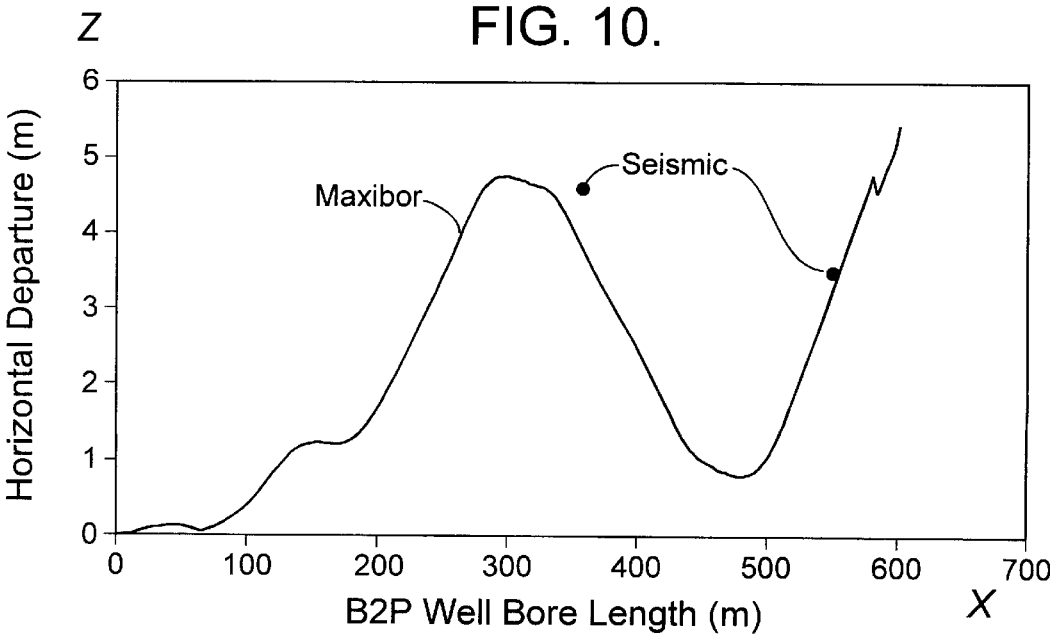
Figure 11:
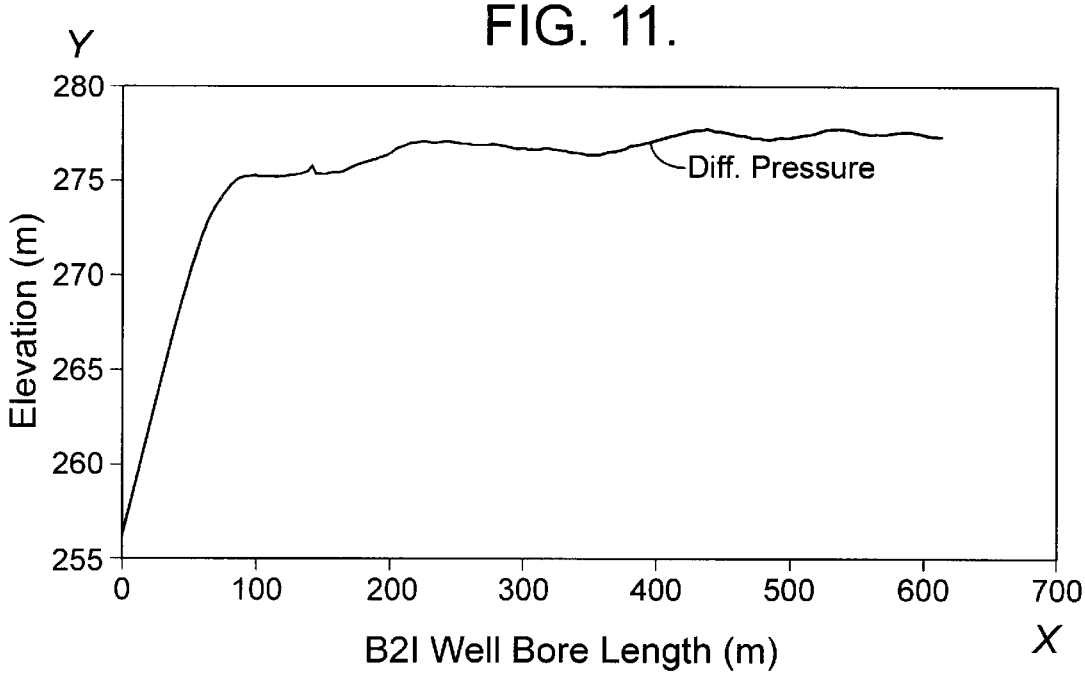
Figure 12:
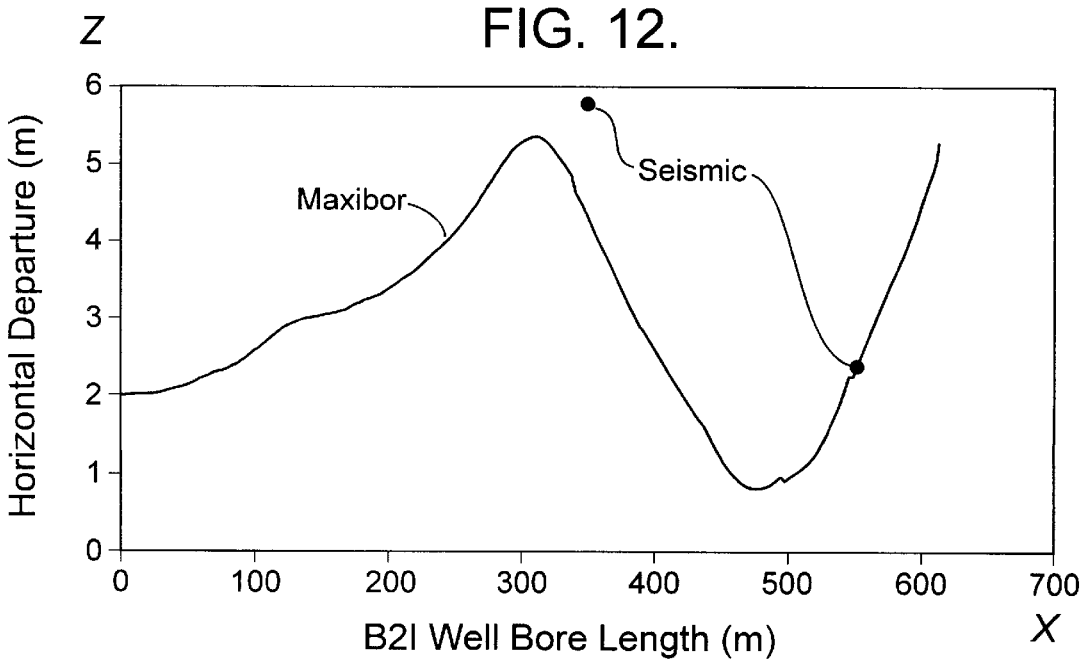
Figure 13:
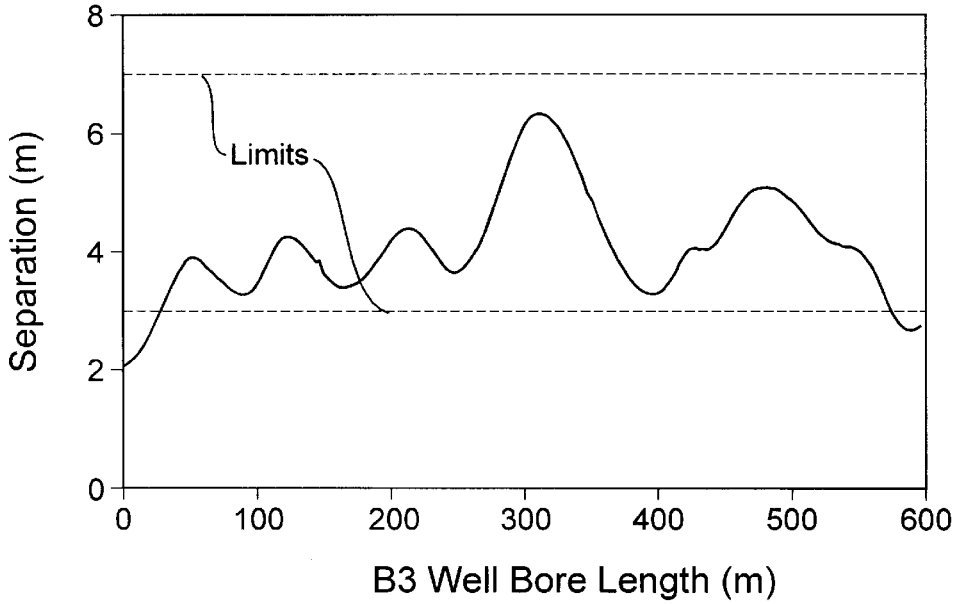
Figure 14:
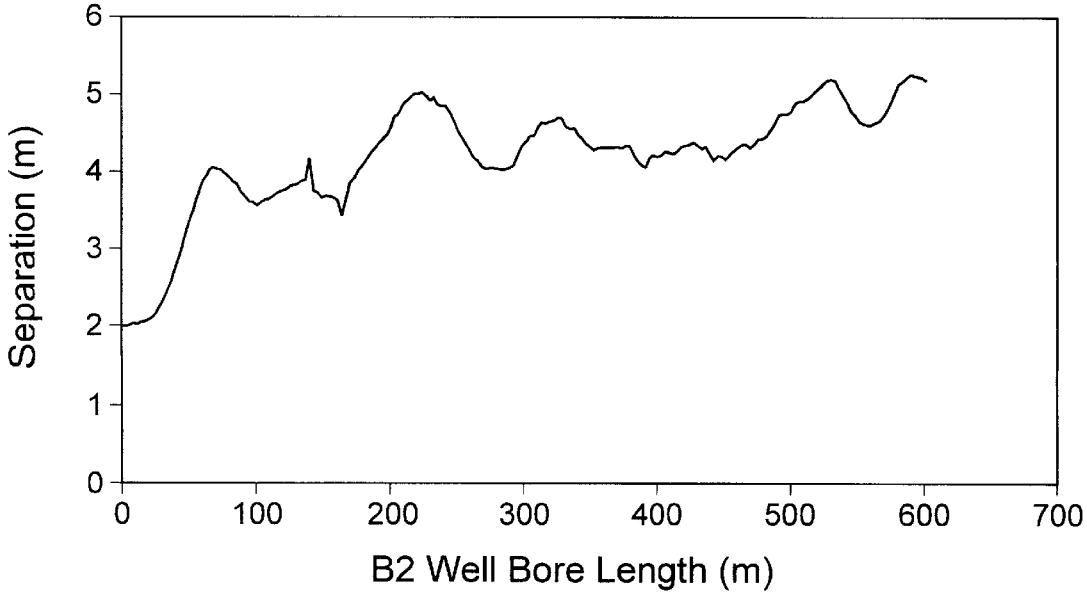

FIG. 7 is a graph comparing the X-Y profiles of the B3 injector wellbore, as determined by each of a pressure tool and a gyro tool;

FIG. 8 is a graph comparing the Z-X departure profiles of the B3 injection wellbore, as determined by each of a FOTOBOR tool and a gyro tool;

FIG. 9 is a graph showing the X-Y profile of the B2 production wellbore, as determined by a pressure tool;

FIG. 10 is a graph showing the Z-X departure profile for the B2 production wellbore, as determined by a MAXIBOR tool;

FIG. 11 is a graph showing the X-Y profile of the B2 injector wellbore, as determined by a pressure tool;

FIG. 12 is a graph comparing the Z-X departure profile of the B2 injection wellbore, as determined by a MAXIBOR tool;

FIG. 13 is a graph showing the final separation, or spacing, between the B3 production and injection wellbores; and FIG. 14 is a graph showing the final separation, or spacing, between the B2 production and injection wellbores.

DETAILED DESCRIPTION OF THE PREFERRED EMBODIMENT

Figure 2:
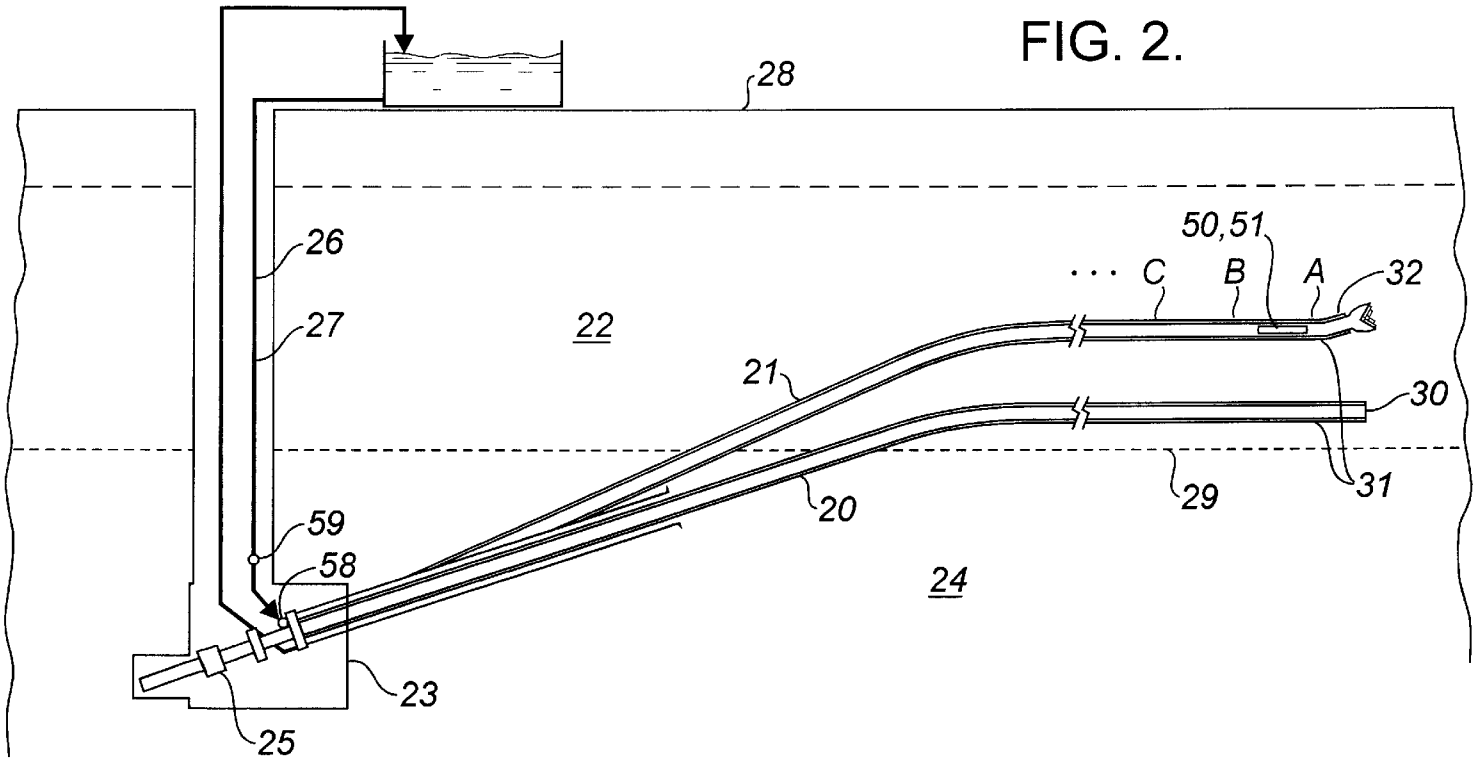
FIG. 2 is a side view of a pair of wellbores extending into an oil sand formation from a shaft, the wells being spaced one above another in close, parallel arrangement such as is typically the case in the SAGD process.

As previously mentioned, the invention was developed in connection with the UTF test facility for recovering oil from subterranean oil sand. This facility involved pairs of vertically spaced and parallel wells extending horizontally through the oil sand. The wells were drilled from a tunnel at the foot of a vertical shaft. The UTF facility is schematically shown in FIG. 2.

However, the invention also finds application in horizontal wells drilled from ground surface as well as conventional vertical wells.

Figure 1:
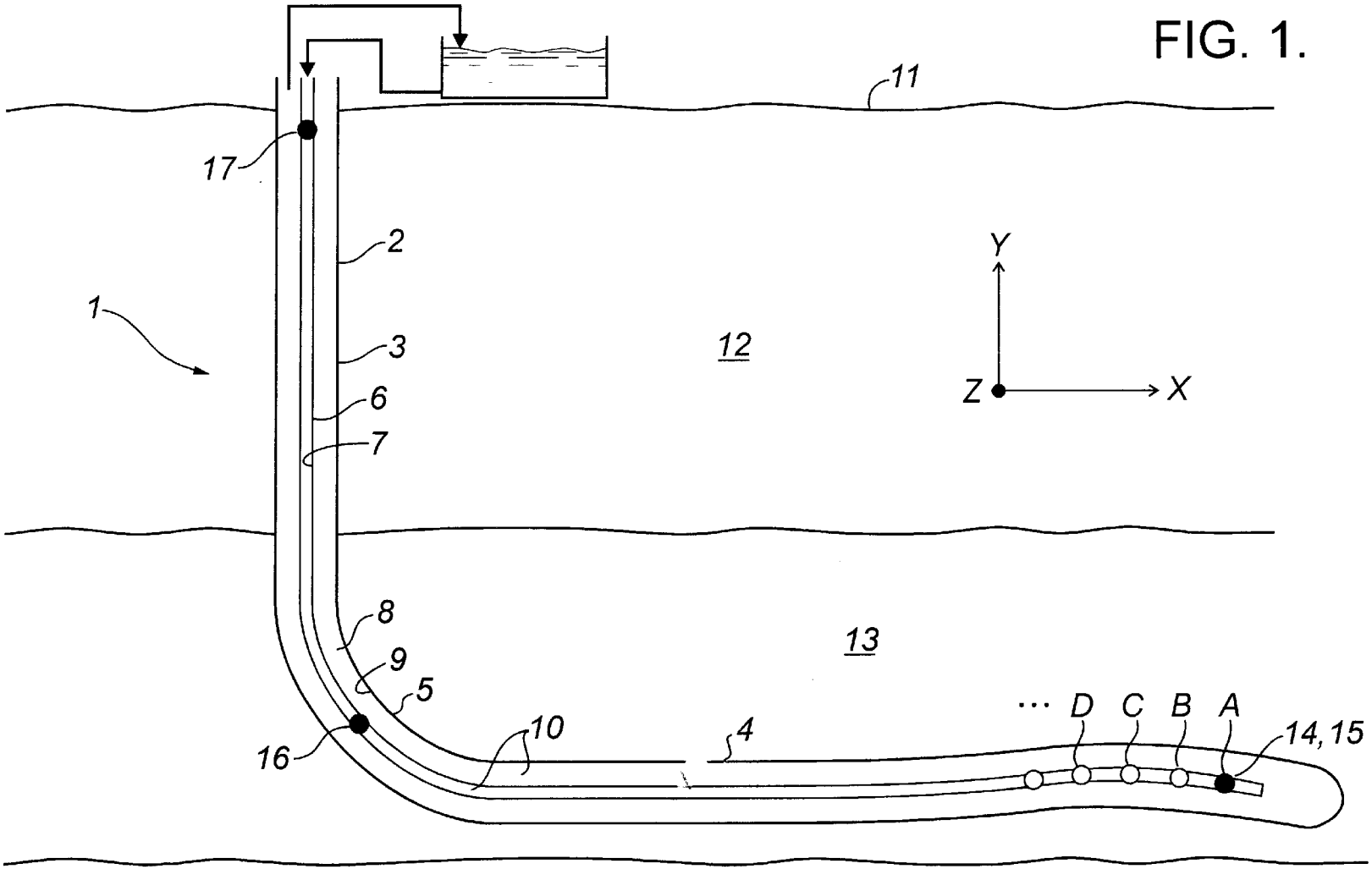
FIG. 1 is a cross-sectional view of a well extending into a subterranean reservoir, the well being fitted with a pressure sensing system of the present invention.

The invention is first described in the context of a horizontal well drilled from ground surface, as shown in FIG. 1.

More particularly, the well 1 has a wellbore 2 comprised of a vertical segment 3, a horizontal segment 4 and a curved segment 5 joining segments 3 and 4.

A drill string 6 extends through the wellbore 2. The bore 7 of the drill string 6 and the annular space 8, formed between the drill string and the wellbore wall 9, is filled with drilling fluid 10 having a generally constant density.

The wellbore 2 extends downwardly from ground surface 11, through the overburden 12 and bends to extend horizontally through the reservoir 13.

The path of the well 1 is defined by a series of coordinates referenced to the three orthogonal axes, X, Y, and Z. The X axis extends horizontally along the intended path of the horizontal wellbore (ie. oriented towards the East). The Y axis represents vertical variations (elevation) referenced from the X axis. Taken together, the variation in the well's path in X and Y coordinates is termed the profile (side view) and is shown in FIG. 1.

The Z axis represents lateral variations or departure in the path, as referenced from the X axis. The X and Z coordinates define an overhead view of the path that is termed the "plan" (not shown). Taken together, the profile and plan define the absolute coordinates of the path of the well 1 in three-dimensional, orthogonal space.

To establish the path of the wellbore 2, the elevation Y, the horizontally extending length X and the departure Z of the wellbore from the X axis must be determined at a plurality of locations or survey stations A, B, C, and so on.

For establishing an absolute measure of the elevation along a wellbore 2, a pressure tool 14 is fitted with a first pressure sensor 15. The pressure tool 14 is adapted to work downhole in a wellbore. The first pressure sensor 15 is in communication with the fluid 10 extending through the drill string 6, thus providing measures of the fluid's pressure. The pressure tool 14 can be run on a cable or wireline 57 (not shown in FIG. 1) into the drill string 6 and moved incrementally to each of the survey stations A,B,C etc. A second pressure sensor 16 is positioned in the drill string 6, in communication with the same fluid 10 near the bottom of the vertical section 3, at a known elevation.

If the density of the fluid 10 is unknown, an optional third pressure sensor 17 is placed in the wellbore 2, in communication with the fluid 10, at a known elevation different from the second sensor 16 and preferably between the surface 11 and the second sensor.

Fluid pressure ($P_3$) measured at the third pressure sensor 17 can be compared with the fluid pressure ($P_2$) measured at the second pressure sensor 16. From a knowledge of the vertical distance $h_{2-3}$ between the second and third sensors 16,17 one can calculate the density (ρ) of the fluid extending therebetween. Numerically this is represented as:

$$\rho = \frac{(P_2 - P_3)}{h_{2-3} \cdot g} \quad (1)$$

To determine the elevation at survey station A, the pressure tool 14, with the first pressure sensor 15, is moved to position A in the wellbore 2. Fluid pressure ($P_1$) measured at the first pressure sensor 15 is compared with the fluid pressure ($P_2$) measured at the second pressure sensor 16. Knowing the density of the fluid (ρ) extending contiguously therebetween one can calculate the differential height ($h_{1-2}$). Numerically this is represented as:

$$h_{1-2} = \frac{(P_1 - P_2)}{\rho \cdot g} \quad (2)$$

The elevation of the first pressure sensor 15 at that station A is determined by adding the differential height $h_{1-2}$ to the known absolute elevation at the second pressure sensor 16.

The downhole tool 14 and first pressure sensor 15 can be repeatedly moved along the wellbore from station-to-station to determine the absolute elevation at each of a plurality of stations A, B, C etc.

The higher the precision of the pressures sensors 15,16, 17, the greater is the accuracy of the elevation determination.

Several corrections to the elevation may be required. If pressure sensor measurements are acquired during active drilling, then the actual flow of fluid 10 introduces additional complicating variables, including the velocity head and head loss to friction. Preferably the flow of fluid is shut in and the above simplified equations are sufficient. Gravity variations due to elevation change are found to be negligible. Variation in surface-to-downhole temperature must be compensated for if using temperature sensitive pressure sensors.

Having determined the elevation Y at each station, one must determine the horizontally extending location X of the station to define the profile and the departure Z at each station to define the plan.

The horizontally extended length ΔX between stations is determined from a geometric reduction of the distance traversed by the tool along the wellbore 2 and the heading at each station A,B,C. The heading provides the angular orientation of the wellbore 2, in particular; the dip angle, providing relative vertical variation ΔY, and azimuth, providing relative departure variation ΔZ.

If the azimuth or departure ΔZ is zero, that is, the wellbore 2 does not depart laterally from a linear course, then the X and Y coordinates are determinable using the pressures sensors, the traversed distance along the wellbore and the dip angle of the wellbore at each station.

If the departure is non-zero, the X and Z coordinates (areal position) of each station along the wellbore are not determinable using the pressure sensors 15,16 alone. Such areal positioning means typically comprise known relative measurement tools, such as the aforementioned gyro and MAXIBOR tools.

The elevation information obtained using the pressure sensors 15,16,17 is accurate. The areal positioning information obtained from relative measurement tools is less accurate. The significance of obtaining an improvement in accuracy for only one of three dimensions (elevation) is illustrated in an example which demonstrates application of the present invention to a SAGD process.

EXAMPLE

The Wells

Having reference to FIG. 2, a typical SAGD producer/injector well pair is shown. A total of three well pairs corresponding with FIG. 2 were drilled; and are identified in the data given herein below as B3 and B2. Well pair B3 was the pair drilled first. A producer wellbore 20 and an injector wellbore 21 were drilled generally upwardly into an oil sand formation 22 from a well head 25 located in an access tunnel 23 formed in a underlying limestone formation 24. Drilling fluid 26 was supplied through a stand pipe 27 connecting the well head 25 to the ground surface 28. Both the producer and injector wellbores 20,21 were initiated near the ceiling of the tunnel 23 and were spaced apart laterally by about 2 meters. The producer wellbore 20 curved upwards and then deviated to extend substantially horizontally for about 600 meters, positioned about 1 meter above the interface 29 of the oil sand and limestone formations 22,24. The limestone interface 29 was pre-determined from vertical well coring data. The injector wellbore 21 curved both laterally (to close the initial 2 meter lateral offset) and upwards to assume a position above the producer wellbore 20. The injector wellbore 21 then also deviated to extend horizontally above the producer wellbore 20. The objective was for the injector wellbore 21 to extend substantially parallel and spaced within a certain tolerance (envelope) from the producer wellbore 20.

Figure 3:
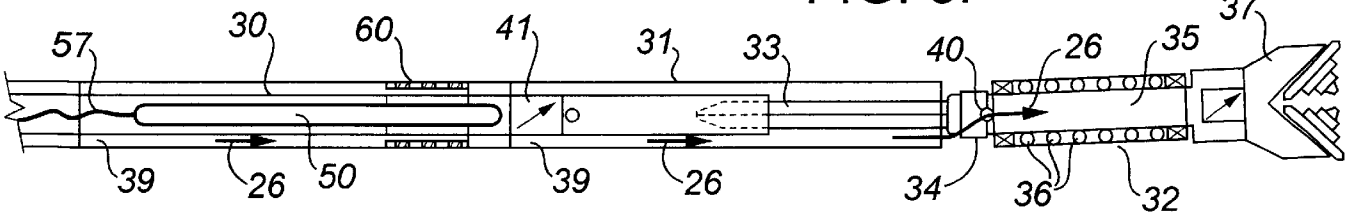
FIG. 3 is a cross-sectional side view of the end of a well's drill string, detailing the bent sub and showing the location of the downhole tool.

The wellbores 20,21 used in the SAGD implementation were specialized in that they comprised both an inner drill string 30 and an outer drill string 31. The outer drill string 31 was fitted with a bent sub 32 at its end. The bent sub 32 was rotatable with the outer drill string 31 so as to orient it and enable directional drilling. Referring to FIG. 3, the inner drill string 30 was connected at its end by a kelly 33 and universal joint 34 to a hollow tail shaft 35 extending through the bent sub 32. The tail shaft 35 was guided with bearings 36 and was connected to a drill bit 37 projecting from the end of the bent sub 32. The inner drill string 30 rotated the drill bit 37 for drilling. Drilling fluid 26 was pumped through the annular space 39 between the outer and inner drill strings 31,30. The fluid 26 was shunted over from the annulus 39, through a port 40 and on through the tail shaft 35 so as avoid the bearings. The fluid 26 ultimately exited at the bit 37. A check valve 41 prevented a return flow of fluid 26 back up the inner drill string 30.

The Tools

Figure 4:
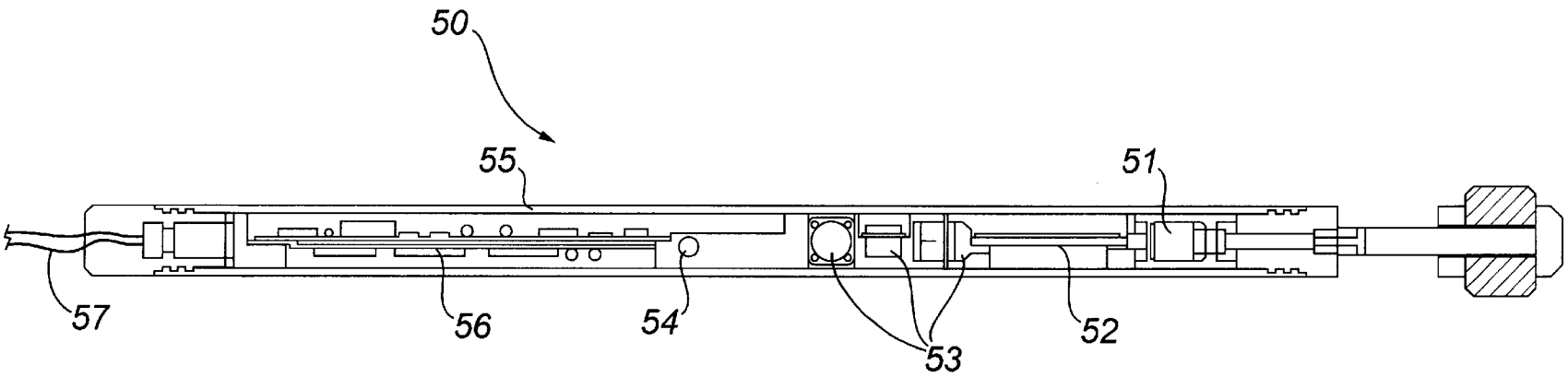
FIG. 4 is a cross-sectional view of the pressure tool.

Referring to FIGS. 2–4, a pressure tool 50 was provided comprising a first pressure sensor 51, a temperature sensor 52, an accelerometer triad 53 and a magnetic sensor pickup 54 mounted within in a non-magnetic beryllium copper housing 55. The accelerometer triad 53 measured the orientation of the tool 50 relative to gravity in three orthogonal axes. Stated otherwise, the accelerometer triad provided three accelerometers, each oriented along one of the X, Y, Z axes. The device was used as an inclinometer to measure the pitch (dip angle) and roll (rotational orientation) angles of the bore hole at a station. An appropriate power supply, data conditioning electronics and signal amplifiers 56 were also located within the tool's housing. A wireline 57 extended between the tool 50 and the well head 25 for the transmission of data. A digital encoder was associated with the wireline feed winch (not shown) located at the well head 25 for measuring the distance the tool 50 moved along (traversed) the wellbore. Fluid 26 was used to propel the pressure tool 50 and other tools down the inner drill string 30. The wireline 57 was used to retrieve (winch in) the tool.

A second pressure sensor 58 was positioned at the bottom of the tunnel 23 at the well head 25. A third pressure sensor 59 was positioned higher in the stand pipe 27, above the tunnel 23.

The pressure sensors 51,58,59 used were of the quartz crystal transducer type. More specifically, each pressure sensor was a Series 1000, "Digiquartz Intelligent Transmitter" available from Paroscientific. The sensors were capable of yielding an actual accuracy of ±0.5 meters in the wellbore.

A temperature sensor 52 was used to provide information for correcting the pressure sensor output in a conventional manner.

Each accelerometer of the triad 53 was a Columbia Research Labs, Inc., model # SA-120R.

For directional drilling, determination of the orientation of the bent sub 32 was also important. The orientation of the bent sub was not directly determinable. Although the bent sub 32 is rigidly connected to the outer drill string 31, which is visible at the tunnel 23, there are unknown rotational variations due to the intervening joint connections and the torsional elasticity of the long drill string 31. Therefore, an array 60 of magnets was positioned on the outer drill string 31, adjacent the end of the inner drill string 30. The magnetic sensor 54 in the pressure tool 50 detected the alignment of the array 60, orienting the bent sub 32 to the tool 50. The beryllium copper tool housing 55 prevented interference with the magnetic sensor 54.

The tool's accelerometer triad 53 oriented any rotation of the tool 50 to vertical. Therefore, the bent sub 32 rotational orientation to vertical was then determinable.

The areal position (in two dimensions, X is determined and Z is assumed=zero) of the pressure tool 50 was determined from the geometric relationship of the dispensed length of wireline 57 and the incremental relative orientation of the pressure tool 50 from station-to-station. The dip angle of the pressure tool at each station was determined from the accelerometer triad 53. This combination of elevation Y, distance traversed by the tool and the tool's dip angle (from which X can be determined) permitted a two-dimensional determination of the wellbore profile (X,Y). The elevation Y determination was absolute. The accuracy of the calculated horizontal extending length X of the wellbore was adversely affected by linearly additive errors.

The horizontally position was also affected by any departure $\Delta Z$ from an ideal linear path in plan (X,Z).

For detecting significant lateral variations or departure Z in the wellbore path, conventional relative tools such as the gyro or MAXIBOR tool were used. The MAXIBOR tool was preferred as it was more rugged. Both relative tools were capable of independently determining dip angle, azimuth and roll, thereby enabling them to establish measures of variation of the wellbore 20,21 from the intended wellbore path in both profile and plan.

Procedure

A wellbore survey required the use of both a relative tool and the pressure tool. The relative tool was used occasionally to provide measurements for determining the departure data and the pressure tool was used repeatedly and frequently to provide accurate elevation data as the drilling progressed.

Initially and periodically thereafter, a full survey traverse was performed by running a relative tool, such as a gyro or MAXIBOR tool, in the inner drill string 30 and pumping it downhole to the end of a wellbore 20,21. Advantageously, as the inner string 30 was free of drilling fluid or mud (excluded by the check valve 41), mine water was used to pump the tool downhole. As a fluid 26, the mine water was ideal, being relatively clean and having a constant, known density.

Wireline 57 was dispensed correspondingly from the wireline winch as the tool was run in. The wireline 57 was then winched back in, typically in 3 meter increments, between stations A–B, B–C, etc.

The relative tool measured the change in displacement between stations as recorded by the length of wireline 57 retrieved. The tool also measured the dip angle and the azimuth at the current station. The tool was moved repeatedly and incrementally to the start of the wellbore 20,21, obtaining measurements at each station, to complete a traverse. The relative tool had to be traversed to the start of the wellbore to tie in all the relative data with the known heading and position of the well head. The heading and coordinates at the well head 25 had been accurately and previously obtained using conventional mine survey methods.

An elevation-determining traverse was similarly performed by pumping the pressure tool downhole. The pressure tool 50 and the relative tools could be pumped downhole sequentially or together.

As vertical changes in the dip angle of the wellbore typically exhibit greater variation $\Delta Y$ (related to the effort to maintain dip angle against gravity) than do the azimuthal changes $\Delta Z$, relative tools suffer greater errors in determining elevation Y than they do in determining departure Z. Therefore, although relative tools provided satisfactory accuracy for departure, there was a greater dependence upon the pressure tool 50 survey to derive accurate elevation information and thus contribute to the determination of the wellbore profile.

Once the full survey traverse with both tools was completed, the absolute coordinates of the end of the wellbore were known, and in particular, the elevation was accurately known.

The wellbore was further extended, drilling addition sections and performing elevation-determining surveys after each section was drilled. The additional survey data was acquired to ensure the elevation of the newly drilled wellbore continued to lay along the desired path. Using the traversed distance and the known elevation of the end of the previous survey, it was possible to pump the pressure tool downhole and start the next survey where the previous survey left off. In this way, a time consuming full survey was avoided, making it possible to quickly and accurately measure and determine the critical elevation data and thus guide the new section of wellbore. Any variations in the departure (which may be determined only with a relative tool) would be compensated for after the next full survey.

Accordingly, the pressure tool 50 was pumped downhole to the newly drilled section of wellbore. Any differential pressure across the tool, resulting from its movement, was permitted to equalize. The pressure tool 50 accurately established the elevation for several new stations along the wellbore. This new elevation data was then correlated to the previously obtained elevation data so as to add to and extend the previously determined path of the wellbore.

With solely relative tools, a typical full traverse consumed about 3 hours and was only performed once per day to minimize down-time, after about every 60 meters of drilling. With the pressure tool, it was now possible to drill as little as 12 meters and perform a quick 15 minute survey to confirm the elevation results without the need for a full traverse. More frequent checking of the wellbore path resulted in better drilling guidance.

Results B3 Well

In the well pair B3, the producer well B3P was first drilled and then surveyed using a gyro, a FOTOBOR* tool and the pressure tool. The FOTOBOR tool was simply an earlier, non-digital version of the MAXIBOR tool and was similar in all other respects. The gyro tool was used to measure and report both profile and plan data. The FOTOBOR tool was used to measure and report plan data. The pressure tool and wireline were used to measure and report profile data.

* trade mark

Figure 5:
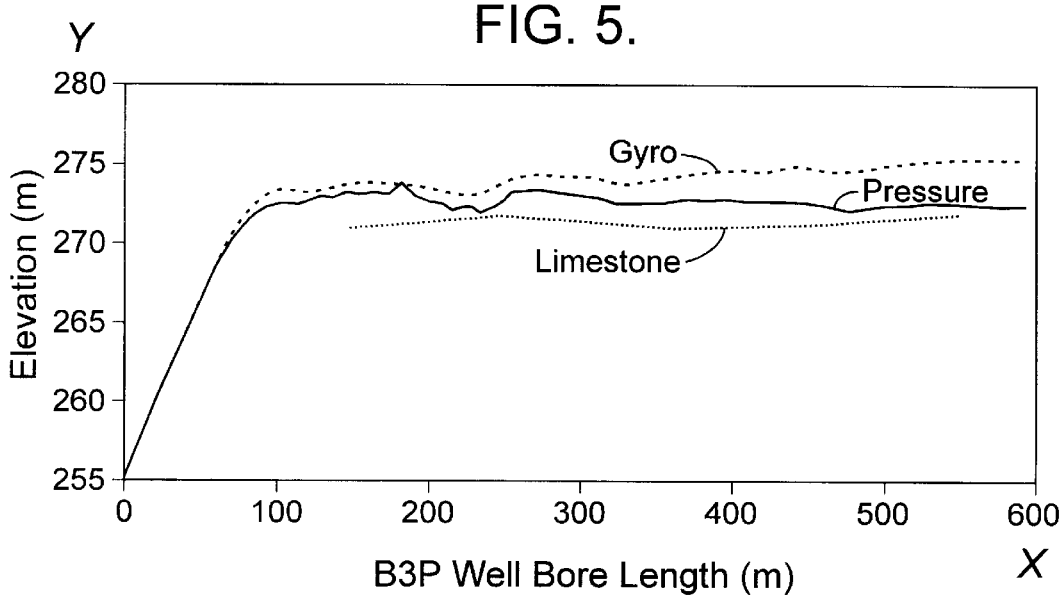
FIGS. 5–14 are based on data yielded by a pilot project described in the Example following below; more particularly
Figure 6:
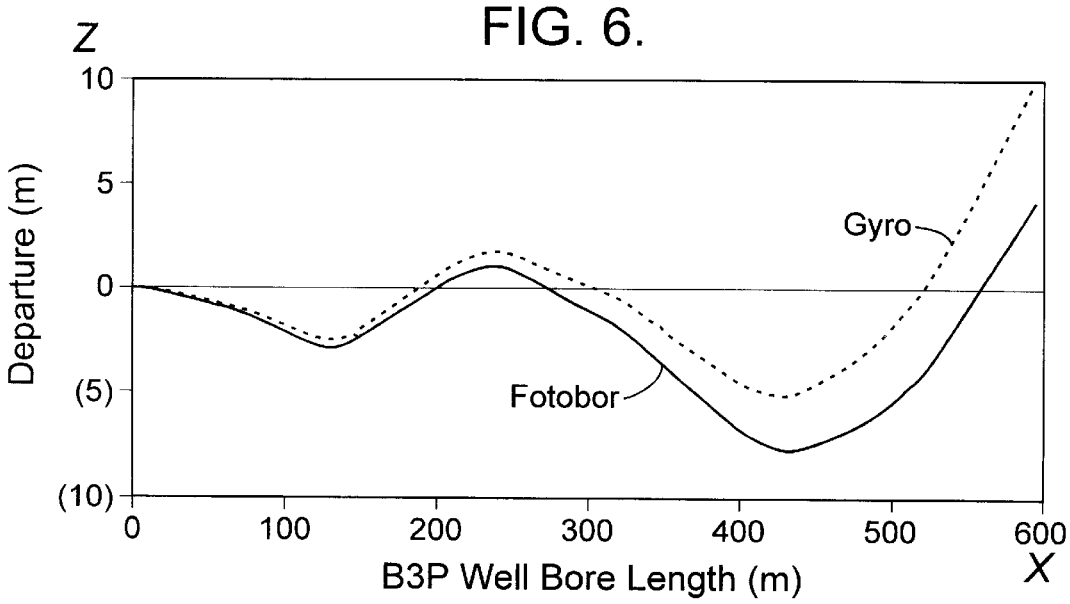

As seen in FIG. 5, a profile, as charted from the gyro and the pressure tool data, is presented. Note the ever increasing variance of the relative gyro tool-derived elevation data from the absolute, pressure tool-derived data. FIG. 6 shows the wellbore plan, presenting the lateral departure as derived from both the gyro and FOTOBOR tools. The data derived from the less-accurate FOTOBOR tool shows an ever accumulating error, or variance, from the gyro tool-derived data.

Using the pressure tool-derived profile and the average relative tool-derived plan, the wellbore path was charted for the producer B3P. The injector wellbore path B3I was then drilled with an objective of remaining within a 3 to 7 meter envelope from the charted path of the producer well B3P. The corresponding profile and plan data for the injector B3I is shown in FIGS. 7 and 8. By comparing the three-dimensional coordinates of the paths of the producer and injector wellbores, the actual separation between the wells was calculated, shown in FIG. 13. The separation remained, for the most part, within the envelope objectives at about 3 to 5 meters (the original separation of 2 meter represents the initial lateral spacing of the wellbores).

Results B2 Well

The B2 well pair represents the last well pair drilled and is demonstrative of accumulated experience and improved technique. The producer well B2P was first drilled and then surveyed using both a MAXIBOR and the pressure tool.

As seen in FIG. 9, the profile, as charted by the pressure tool, is presented. FIG. 10 presents the plan data as derived from the MAXIBOR tool.

Using the profile and plan data from the producer B2P, the path of the injector wellbore B2I was also drilled with the objective of guiding it to remain within a 3 to 7 meter envelope from the known profile of B2P. The corresponding profile and plan data for the injector B2I is shown in FIGS. 11 and 12. As shown in FIG. 14, the separation of the wellbores B2P and B3I remained clearly within the envelope objectives. In fact, the separation fell mostly within the ideal range of 4 to 5 meters.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A method for determining the elevation at a survey point in a subterranean wellbore which is being drilled with a drill string which contains a continuous column of fluid having a known and substantially constant density, comprising:

positioning a downhole tool in the drill string at the survey point, said tool carrying first means for measuring fluid pressure and being connected with second means for transmitting a signal which is indicative of the fluid pressure measurement to third means, located outside the wellbore, for calculating elevation of the survey point;

providing fourth means for measuring fluid pressure at a reference point of known elevation, said fourth means being in pressure sensing communication with the column of fluid and being connected with fifth means for transmitting a signal indicative of the fluid pressure measurement taken at the reference point, to the third means;

measuring the fluid pressure at the reference point and transmitting a signal indicative of the measurement to the third means;

measuring the fluid pressure at the survey point and transmitting a signal indicative of the measurement to the third means; and calculating the elevation of the survey point by applying the third means which uses the pressure measurements, the density of the fluid and the known elevation of the reference point.

2. The method as recited in claim 1 wherein the density of the fluid is determined by:

providing sixth means for measuring fluid pressure at a second reference point of known elevation different from the elevation of the forth means, said sixth means being in pressure sensing communication with the column of fluid and being connected with seventh means for transmitting a signal, indicative of the fluid pressure measurement taken at the second reference point, to the third means; and measuring the fluid pressure at the second reference point and transmitting a signal indicative of the measurement to the third means; and calculating the density of the fluid by applying the third means which uses the pressure measurements, the known elevations of the first and second reference points.

3. A method for determining the path of a wellbore having a bore containing a continuous column of fluid having a substantially constant density, comprising:

(a) positioning a downhole tool at a survey point in the bore, said tool carrying means for measuring fluid pressure, means for measuring the traversed distance of the tool along the wellbore, and means for measuring the dip angle of the tool, all measured at the survey point;

(b) providing means for measuring fluid pressure at a reference point of known elevation along the length of the column of fluid;

(c) establishing measures indicative of the elevation of the tool at the survey point using the differential between the fluid pressure at the survey point and the reference point and the fluid density;

(d) establishing measures of the dip angle of the tool at the survey point;

(e) establishing measures of the traversed distance of the tool to the survey point;

(f) establishing measures of the horizontal location of the tool using the traversed distance and the orientation of the tool at the survey point (g) moving the tool and measuring means to a new survey point; and (h) repeating steps (c) through (g) for determining measures indicative of the profile of the path of the wellbore knowing the elevation, horizontal position and dip angle of the tool, where the azimuthal deviation of the path assumed to be zero.

4. The method as recited in claim 3 further comprising:

providing means for measuring the azimuthal orientation of the tool at the survey point;

determining measures indicative of the departure of the survey point; and determining measures indicative of the profile and plan of the path of the wellbore knowing the elevation, horizontal position, vertical and azimuthal orientation of the tool.

5. The method as recited in claim 4 wherein the azimuthal orientation measuring means are carried by the tool.

6. The method as recited in claim 3, further comprising:

providing means for measuring fluid pressure at a second reference point located in the column of fluid and at a known elevation which is different than the first reference point; and calculating the density of the fluid using the difference in fluid pressure pressures between the first and second reference points.

7. A method for controlling the direction of advance of a drilling string equipped with a bent sub and functioning to drill a horizontal wellbore, said string having a bore containing a continuous column of fluid having a substantially constant density, comprising:

(a) positioning a downhole tool at a survey point in the bore, said tool carrying means for measuring fluid pressure, means for measuring the traversed distance of the tool along the wellbore, means for measuring the dip angle of the tool, means for measuring the tool's rotational orientation from vertical and means for measuring the bent sub's rotational orientation relative to the tool, all measured at the survey point;

(b) providing means for measuring fluid pressure at a reference point of known elevation along the length of the column of fluid;

(c) establishing measures indicative of the elevation of the tool at the survey point using the differential between the fluid pressure at the survey point and the reference point and the fluid density;

(d) establishing measures of the dip angle of the tool at the survey point;

(e) establishing measures of the traversed distance of the tool to the survey point;

(f) establishing measures of the horizontal location of the tool using the traversed distance and the orientation of the tool at the survey point (g) moving the tool and measuring means to a new survey point; and (h) repeating steps (b) through (f) for determining measures indicative of the profile of the path of the wellbore knowing the elevation, horizontal position and vertical orientation of the tool, where the azimuthal deviation of the path assumed to be zero, and for re-orienting the bent sub's rotation to change the direction of advance of the drilling string knowing the rotational orientation of the bent sub relative to the tool and the tool's rotational orientation from vertical.

8. The method as recited in claim 7 further comprising:

providing means for measuring the azimuthal orientation of the tool at the survey point;

determining measures indicative of the departure of the survey point; and determining measures indicative of the profile and plan of the path of the wellbore knowing the elevation, horizontal position, vertical and azimuthal orientation of the tool, and for re-orienting the bent sub's rotation to change the direction of drilling knowing the rotational orientation of the bent sub relative to the tool and the tool's rotational orientation from vertical.

* * * * *